US006499454B2

(12) United States Patent
Miyazato et al.

(10) Patent No.: US 6,499,454 B2
(45) Date of Patent: Dec. 31, 2002

(54) VARIABLE-VALVE-ACTUATION APPARATUS FOR INTERNAL COMBUSTION ENGINE

(75) Inventors: Yoshiaki Miyazato, Kanagawa (JP); Seinosuke Hara, Kanagawa (JP); Makoto Nakamura, Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/908,924

(22) Filed: Jul. 20, 2001

(65) Prior Publication Data

US 2002/0007809 A1 Jan. 24, 2002

(30) Foreign Application Priority Data

Jul. 21, 2000 (JP) ..... 2000-220397

(51) Int. Cl.[7] ..... F01L 1/02

(52) U.S. Cl. ..... 123/90.31; 123/90.15; 123/90.16; 123/90.17; 123/90.27; 123/90.34; 123/90.6

(58) Field of Search ..... 123/90.16, 90.15, 123/90.17, 90.4, 90.44

(56) References Cited

U.S. PATENT DOCUMENTS 5,988,125 A 11/1999 Hara et al. ..... 123/90.16
6,029,618 A 2/2000 Hara et al. ..... 123/90.16
6,041,746 A 3/2000 Takemura et al. ..... 123/90.16
6,055,949 A 5/2000 Nakamura et al. ..... 123/90.16
6,123,053 A 9/2000 Hara et al. ..... 123/90.16
6,260,523 B1 * 7/2001 Nakamura et al. ..... 123/90.15

* cited by examiner

*Primary Examiner*—Thomas Denion
*Assistant Examiner*—Ching Chang
(74) *Attorney, Agent, or Firm*—Foley & Lardner

(57) ABSTRACT

A VVA apparatus includes a driving shaft, a crank cam arranged at an outer periphery of the driving shaft, a VO cam swingably supported by the driving shaft to actuate an engine valve, and a rocker arm having a first arm swingably mounted to an eccentric control cam at a first pivotal point and a second arm rotatably mounted to the crank cam and the VO cam at a second pivotal point and a third pivotal point, respectively, the rocker arm transmitting a driving force of the crank cam to the VO cam. The valve lift produced by the VO cam is varied by changing a rocking fulcrum of the rocker arm through rotation control of the control cam, and the second pivotal point and the third pivotal point are located on the side of the second arm of the rocker arm.

14 Claims, 10 Drawing Sheets

VARIABLE-VALVE-ACTUATION APPARATUS FOR INTERNAL COMBUSTION ENGINE

BACKGROUND OF THE INVENTION

The present invention relates to a variable-valve-actuation (VVA) apparatus for an internal combustion engine that can vary, particularly, the lift amount of valves such as intake valve and exhaust valve in accordance with engine operating conditions.

The VVA apparatus typically comprises an eccentric rotary (ER) cam fixed to a driving shaft for rotation therewith, a pivotal valve operating (VO) cam, a rocker arm having a first arm and a second arm, a control rod or shaft having an eccentric control cam, and a crank arm. The eccentric control cam supports the rocker arm for pivotal motion. The crank arm interconnects the ER cam and the first arm of the rocker arm. A link interconnects the second arm of the rocker arm and the VO cam.

The VVA apparatus is constructed to change a rocking fulcrum of the rocker arm in accordance with the rotating position of the control cam to obtain variable valve-lift characteristic. However, no consideration is given to rotation control of the control cam, i.e. a load acting on the control shaft during rotation thereof. As a consequence, a load on an actuator for driving the control shaft becomes greater to produce greater driving energy. This leads not only to an increase in size of the actuator, but to a possible degradation of power consumption for the actuator and fuel consumption for the engine.

SUMMARY OF THE INVENTION

It is, therefore, an object of the present invention to provide a VVA apparatus for an internal combustion engine, which contributes to the optimization of power consumption for the actuator and fuel consumption for the engine without increasing a size of the actuator.

The present invention generally provides a VVA apparatus for an internal combustion engine, comprising:

- a driving shaft that rotates in synchronism with a crankshaft;
- a crank cam arranged at an outer periphery of the driving shaft;
- a VO cam swingably supported by the driving shaft, the VO cam actuating an engine valve; and
- a rocker arm having a first arm swingably mounted to an eccentric control cam at a first pivotal point and a second arm rotatably mounted to the crank cam and the VO cam at a second pivotal point and a third pivotal point, respectively, the rocker arm transmitting a driving force of the crank cam to the VO cam,
- wherein a lift of the engine valve produced by the VO cam is varied by changing a rocking fulcrum of the rocker arm through rotation control of the control cam, and
- wherein the second pivotal point and the third pivotal point are located on the side of the second arm of the rocker arm.

BRIEF DESCRIPTION OF THE DRAWINGS

The other objects and features of the present invention will be apparent from the description with reference to the accompanying drawings wherein.

DETAILED DESCRIPTION OF THE INVENTION

Figure 1:
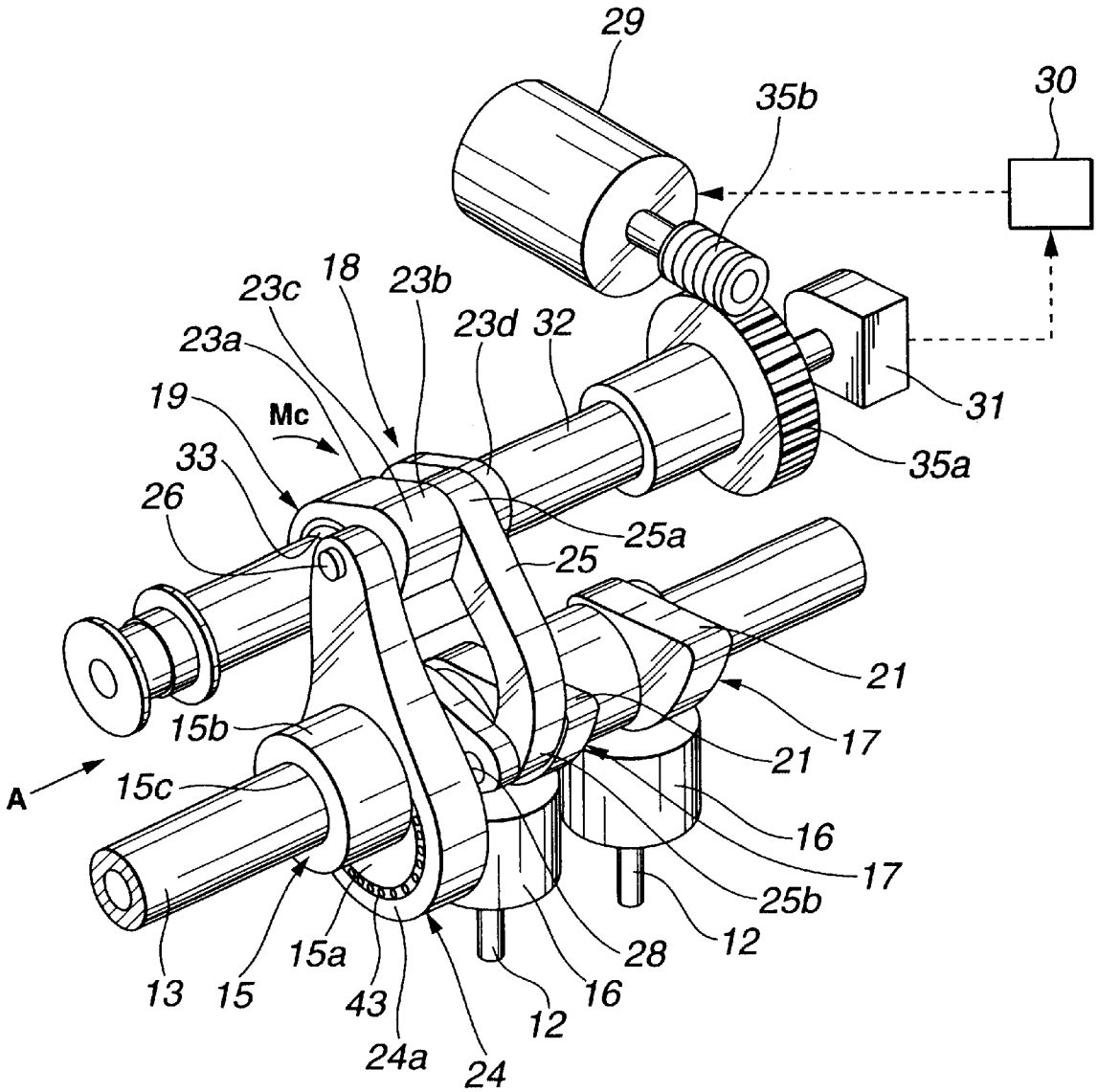
FIG. 1 is a perspective view showing a first embodiment of a VVA apparatus for an internal combustion engine according to the present invention.

Referring to the drawings, a description will be made with regard to a VVA apparatus for an internal combustion engine embodying the present invention. In embodiments of the present invention, the VVA apparatus comprises two intake valves per cylinder and an alteration mechanism for varying the lift amount of the intake valves in accordance with the engine operating conditions.

Figure 2:
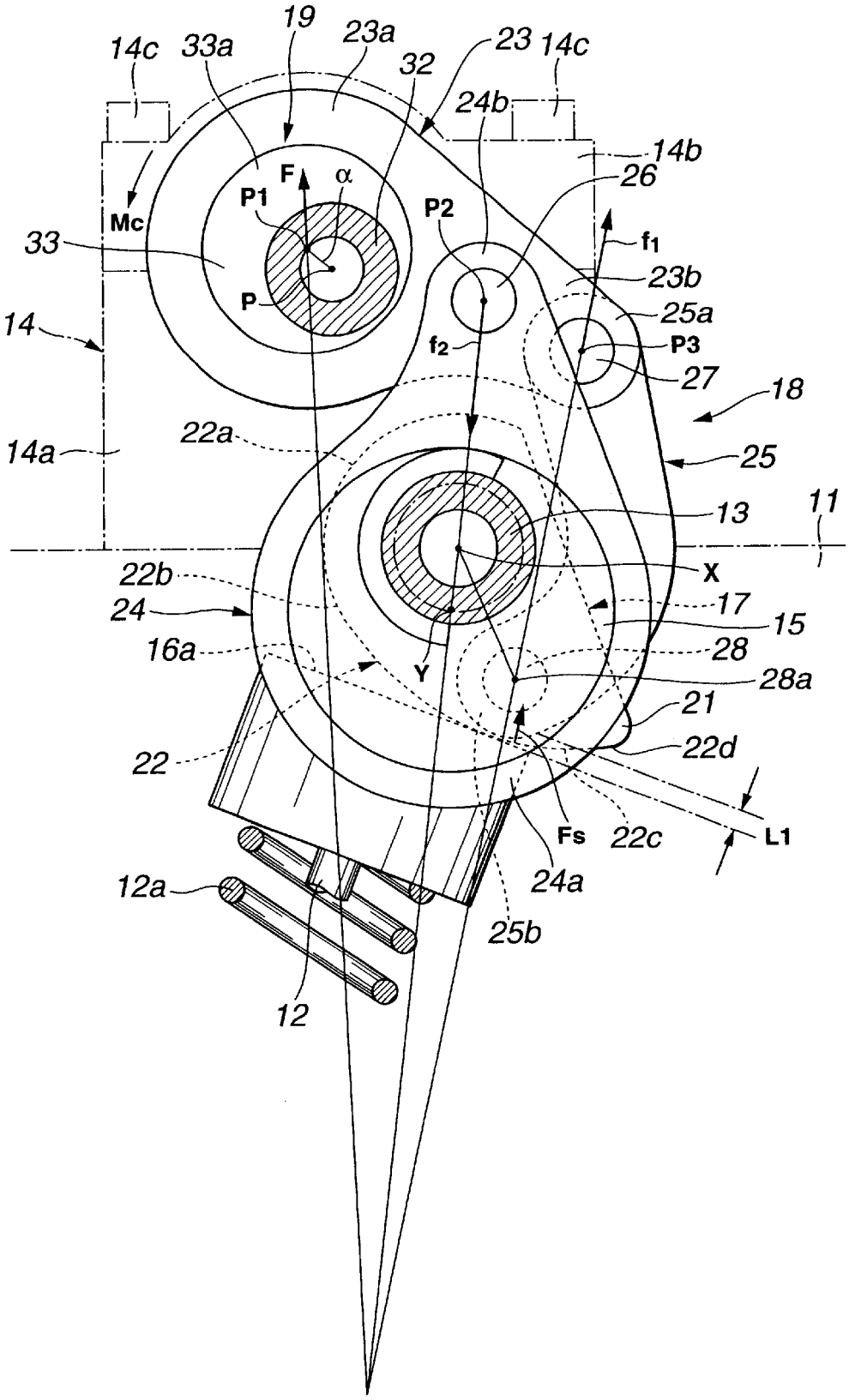
FIG. 2 is a schematic view showing the apparatus in the valve-open state at the minimum lift control as seen from arrow A in FIG. 1.

Specifically, referring to FIGS. 1–2, the VVA apparatus comprises a pair of intake valves 12 slidably mounted to a cylinder head 11 through a valve guide, not shown, a hollow driving shaft 13 rotatably supported by a bearing 14 in an upper portion of the cylinder head 11, a crank or eccentric rotating cam 15 fixed to the driving shaft 13 through a connecting pin, a pair of VO cams 17 swingably supported on an outer peripheral surface of the driving shaft 13 and coming in slide contact with valve lifters 16 disposed at the upper ends of the intake valves 12 to open them, a transmission mechanism 18 connected between the crank cam 15 and the VO cams 17 for transmitting as a rocking force torque of the crank cam 15 to the VO cams 17, and an alteration mechanism 19 for varying the operating position of the transmission mechanism 18.

The driving shaft 13 extends in the engine longitudinal direction, and has one end with a follower sprocket, a timing chain wound thereon, etc., not shown, through which the driving shaft receives torque from an engine crankshaft. The driving shaft 13 is constructed to rotate counterclockwise as viewed in FIG. 1. The driving shaft 13 is formed out of a material of high strength.

The bearing 14 comprises a main bracket 14*a* arranged at the upper end of the cylinder head 11 for supporting an upper portion of the driving shaft 13, and an auxiliary bracket 14*b* arranged at the upper end of the main bracket 14*a* for rotatably supporting a control shaft or rod 32 as will be described later. The brackets 14*a*, 14*b* are fastened together from above by a pair of bolts 14*c*.

As shown in FIG. 2, the crank cam 15, which is a unitary structure of a wear resistant material, is formed substantially like a ring, and comprises an annular main body 15*a* and a cylindrical portion 15*b* integrated with the outer end face thereof. A though hole 15*c* is axially formed through the crank cam 15 to receive the driving shaft 13. An axis Y of the main body 15*a* is radially offset with respect to an axis X of the driving shaft 13 by a predetermined amount. The crank cam 15 is coupled with the driving shaft 13 by the connecting pin arranged through the driving shaft 13 in the radial direction of the cylindrical portion 15*b*. A crescent flat surface is formed on one side face of the cylindrical portion 15*b* on the side of the cam main body 15*a*. The crank cam 15 is constructed to rotate counterclockwise as viewed in FIG. 2 with rotation of the driving shaft 13.

The valve lifters 16 are formed like a covered cylinder, each being slidably held in a hole of the cylinder head 11 and having a flat top face 16*a* with which the VO cam 17 comes in slide contact.

As shown in FIGS. 1–2, the VO cam 17 is formed roughly like a raindrop, and has a support hole at a roughly cylindrical base end 20, through which the outer peripheral surface of the driving shaft 13 is supported rotatably. The VO cam 17 also has a pinhole on the side of a cam nose 21. A lower face of the VO cam 17 is formed with a cam face 22 including a base-circle face 22*a* on the side of the base end 20, a ramp face 22*b* circularly extending from the base-circle face 22*a* to the cam nose 21, and a lift face 22*c* extending from the ramp face 22*b* to a top face 22*d* with the maximum lift arranged at a tip of the cam nose 21. The base-circle face 22*a*, the ramp face 22*b*, the lift face 22*c*, and the top face 22*d* come in contact with respective predetermined points of the top face 16*a* of the valve lifter 16 in accordance with the rocking position of the VO cam 17.

Specifically, a predetermined angular range of the base-circle face 22*a* corresponds to a base-circle section, and a predetermined angular range of the ramp face 22*b* subsequent to the base-circle section corresponds to a ramp section, and a predetermined angular range of the ramp face 22*b* from the ramp section to the top face 22*d* corresponds to a lift section.

The transmission mechanism 18 comprises a rocker arm 23 disposed above the driving shaft 13 and having cylinder-shaped first arm 23*a* swingably supported, a crank arm 24 for linking one portion of a second arm 23*b* of the rocker arm 23 with the crank cam 15, and a link rod 25 for linking another portion of the second arm 23*b* of the rocker arm 23 with the VO cam 17.

As shown in FIGS. 1–2, the first arm 23*a* of the rocker arm 23 is swingably supported by an eccentric control cam 33 as will be described later through a support hole, wherein an axis P1 of the control cam 33 forms a first pivotal point. The second arm 23*b* protruding from an outer end of the first arm 23*a* is bifurcated into two portions 23*c*, 23*d*. A pin 26 protrudes from an outer side of relatively thick one portion 23*c* to rotatably connect an extension 24*b* of the crank arm 24 as will be described later. Moreover, a pin 27 is interposed between one portion 23*c* and another portion 23*d* to rotatably connect a first end 25*a* of the link rod 25.

The crank arm 24 includes one end or relatively large-diameter annular base end 24*a* and another end or extension 24*b* arranged in a predetermined position of the outer peripheral surface of the base end 24*a*. The extension 24*b* has a pinhole for rotatably receiving the pin 26. An axis P2 of the pin 26 forms a second pivotal point for rotatably supporting the second 23*b* of the rocker arm 23.

As best seen in FIG. 1, the link rod 25 is formed substantially like a letter L having a concave on the side of the rocker arm 23, and has first and second ends 25*a*, 25*b* formed with pinholes through which ends of the pins 27, 28 press fitted in the respective pinholes of the second arm 23*b* of the rocker arm 23 and the cam nose 21 of the VO cam 17 are rotatably arranged. An axis P3 of the pin 27 forms a third pivotal point, which is slightly offset with respect to the axis P2 of the pin 26 as second pivotal point in the vertical and longitudinal directions.

Arranged at one ends of the pins 26, 27, 28 are snap rings for restricting axial movement of the crank arm 24 and the link rod 25.

The alteration mechanism 19 comprises control shaft 32 disposed above the driving shaft 13 and rotatably supported on the bearing 14, and control cam 33 fixed at the outer periphery of the control shaft 32 to form a rocking fulcrum of the rocker arm 23.

As best seen in FIG. 1, the control shaft 32 is disposed parallel to the driving shaft 13 to extend in the engine longitudinal direction, and is constructed to be rotatable within a predetermined angular range by means of an actuator or electric motor 29 arranged at one end of the control shaft 32 and enabling normal and reverse rotation.

As shown in FIG. 2, the control cam 33 is formed like a cylinder, and has axis P1 offset with respect to an axis P of the control shaft 32 by an amount a corresponding to a thick portion 33*a*.

The motor 29 for controllably rotating the control shaft 32 is driven in accordance with a control signal derived from a controller 30 for determining engine operating conditions. The controller 30 serves to compute actual engine operating conditions in accordance with detection signals out of various sensors such as a crank-angle sensor, an airflow meter, a coolant-temperature sensor, etc. Moreover, the controller 30 provides a control signal to the motor 29 in accordance with a detection signal out of a potentiometer 31 for detecting the rotated position of the control shaft 32.

Next, operation of the first embodiment will be described. When the engine is at low velocity and at low load, the control shaft 32 is rotated to a position as shown in FIG. 2 by the motor 29 in accordance with a control signal out of the controller 30. Thus, the axis P1 of the control cam 33 is kept in a rotation-angle position located in the left direction of the axis P of the control shaft 32 as shown in FIG. 2, so that the thick portion 33*a* of the control cam 33 is moved leftward with respect to the driving shaft 13. Thus, the rocker arm 23 is moved in its entirety leftward in rotating counterclockwise about the axis P2. Thus, the VO cam 17, having the cam nose 21 forcibly slightly pulled upward through the link rod 25, is rotated in its entirety to a position as shown in FIG. 2.

Therefore, referring to FIG. 2, when rotation of the crank cam 15 pulls the second arm 23*b* of the rocker arm 23 upward through the crank arm 24, a corresponding lift L1 is transmitted to the VO cam 17 and the valve lifter 16 through the link rod 25, which is smaller as shown in FIG. 2.

Figure 5:
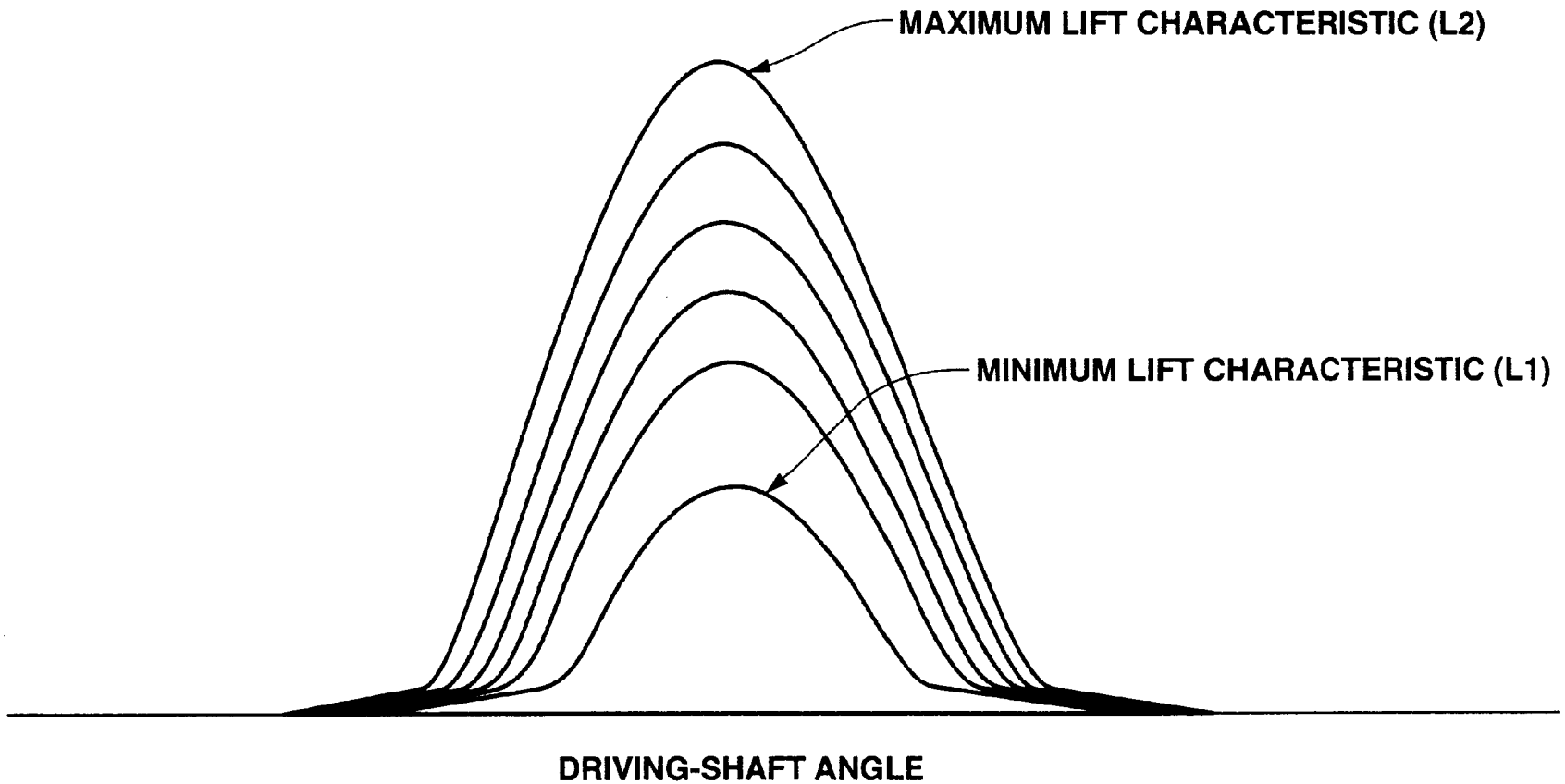
FIG. 5 is a graphical representation illustrating a valve-lift characteristic.

Thus, in such low-velocity and low-load range, referring to FIG. 5, the lift amount of the intake valves 12 is smaller to obtain lowered friction. Moreover, the opening timing of the intake valves 12 is delayed to decrease an overlap between the intake and exhaust valves, resulting in improved fuel consumption and stable engine rotation.

Figure 3:
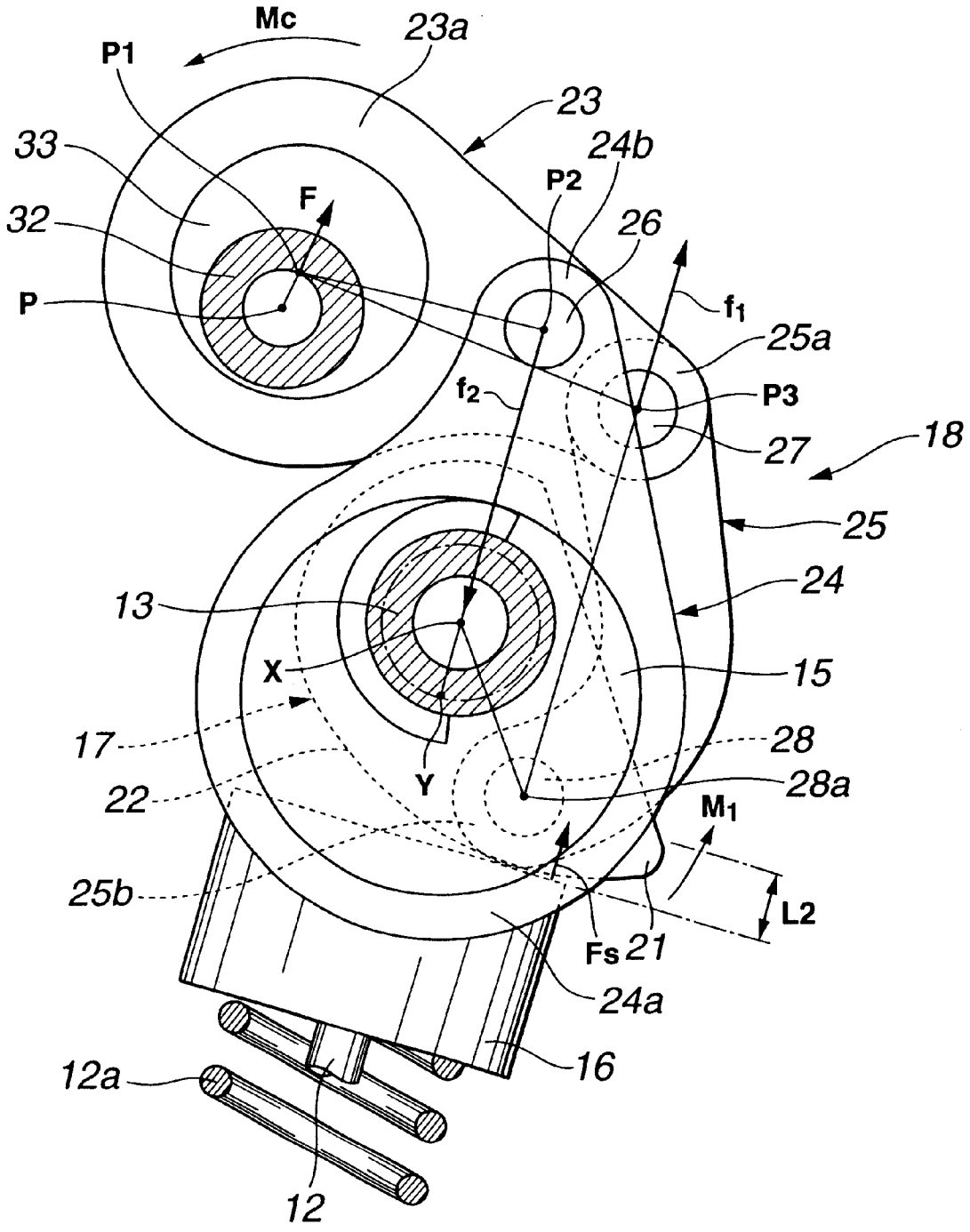
FIG. 3 is a view similar to FIG. 2, showing the apparatus in the valve-open state at the maximum lift control.
Figure 4:
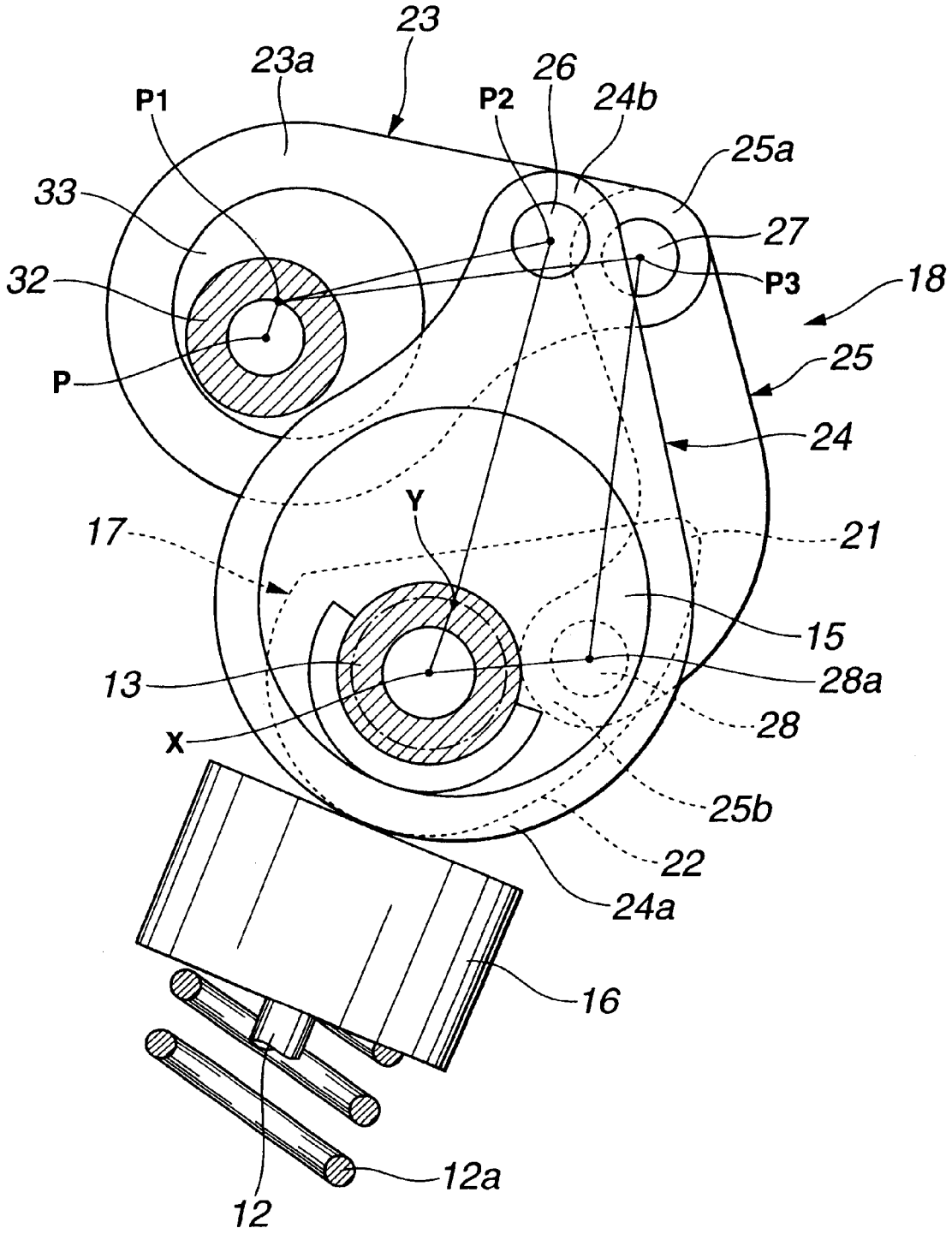
FIG. 4 is a view similar to FIG. 3, showing the apparatus in the valve-closed state.

On the other hand, when the engine operating conditions passes into the high-velocity and high-load range, the control shaft 32 is rotated clockwise by the motor 29 in accordance with a control signal out of the controller 30. Thus, referring to FIGS. 3–4, this rotates the control cam 33 clockwise from the position as shown in FIG. 2 to move the axis P1 (thick portion 33*a*) of the control cam 33 rightward upward. As a result, the rocker arm 23 is moved in its entirety rightward in rotating clockwise about the axis P2, moving the axis P3 rightward downward. Thus, the second arm 23*b* pushes the cam nose 21 of the VO cam 17 downward through the link rod 25, rotating the VO cam 17 in its entirety clockwise by a predetermined amount. FIG. 3 shows the valve-open state (the instant of reaching the maximum lift), and FIG. 4 shows the valve-closed stated.

Therefore, the position of contact of the cam face 22 of the VO cam 17 with respect to the top face 16*a* of the valve lifter 16 is moved rightward or in the direction of the lift portion 22*c* as shown in FIG. 3 with respect to the position as shown in FIG. 2. This rotates the crank cam 15 as shown in FIG. 3 to pull the second arm 23*b* of the rocker arm 23 downward through the crank arm 24, obtaining a larger lift L2 with respect to the valve lifter 16 as shown in FIG. 3.

Thus, the valve-lift characteristic is greater in the high-velocity and high-load range than in the low-velocity and low-load range, so that the valve-lift amount is also greater as shown in FIG. 5. This involves advanced opening timing and delayed closing timing of each intake valve 12, obtaining improved intake-air charging efficiency, allowing achievement of sufficient engine output.

In the first embodiment, both of the second and third pivotal points P2, P3 are collocated on the side of the second arm 23*b* of the rocker arm 23 with respect to the first pivotal point P1 on the side of the first arm 23*a* of the rocker arm 23. Thus, as described above, during rotation from the minimum lift position to the maximum lift position, particularly, a load F acting on the axis P1 of the control cam 33 is sufficiently smaller as compared with that in the apparatus disclosed in commonly assigned U.S. Pat. No. 5,988,125 issued to Hara, et al. on Nov. 23, 1999, the entire contents of which are incorporated hereby by reference.

Specifically, by way of example, referring to FIG. 3, upon opening of the intake valves 12 in the maximum lift range, a force Fs resulting from a spring force of a valve spring 12*a* acts on the VO cam 17 through the valve lifter 16, producing thereby a counterclockwise moment $M_1$. Due to the moment $M_1$, the link rod 25 undergoes a first reaction force $f_1$ operating in the direction of arrow or in the direction of connecting the axes P3, 28*a* of the pins 27, 28 at the first and second ends 25*a*, 25*b* of the link rod 25, which acts on the second arm 23*b* of the rocker arm 23 through the pin 27. Since the second pivotal point P2 is also located on the side of the third pivotal point P3, a second reaction force $f_2$ operates in the direction of arrow or in the direction opposite to that in the apparatus of U.S. Pat. No. 5,988,125, canceling the first reaction force $f_1$.

The reason why the direction of the second reaction force $f_2$ is opposite to that in the apparatus of U.S. Pat. No. 5,988,125 is as follows. In U.S. Pat. No. 5,988,125, since depressing the intake valves 12 through the VO cams 17 is carried out by pushing the rocker arm 23 upward through the crank cam 15 (crank arm 24), the second reaction force $f_2$ operates in the direction opposite to that of the driving shaft 13 or upward. On the other hand, in the illustrative embodiment, since the second pivotal point P2 on which the second reaction force $f_2$ acts as described above is located on the side of the third pivotal point P3 on which the first reaction force $f_1$ acts with respect to the first pivotal point or axis P1 of the control cam 33, depressing the intake valves 12 is carried out by pushing the rocker arm 23 downward through the crank arm 24 by way of the second pivotal point P2.

The cancellation of the reaction forces $f_1$, $f_2$ leads to sufficiently reduced load F acting on the first pivotal point P1 of the rocker arm 23. As a result, a moment Mc acting about the control shaft 32 is also sufficiently reduced to largely lower a required load on the motor 29.

Upon closing of the intake valves 12 as shown in FIG. 4, a great reaction force out of the valve spring 12*a* does not occur, and thus the load F is smaller, producing insignificant load on the motor 29.

Moreover, in the first embodiment, the second pivotal point P2 is slightly offset with respect to the third pivotal point P3 in the vertical and longitudinal directions. This results in adjustable variable lift range of the intake valves 12.

Figure 6:
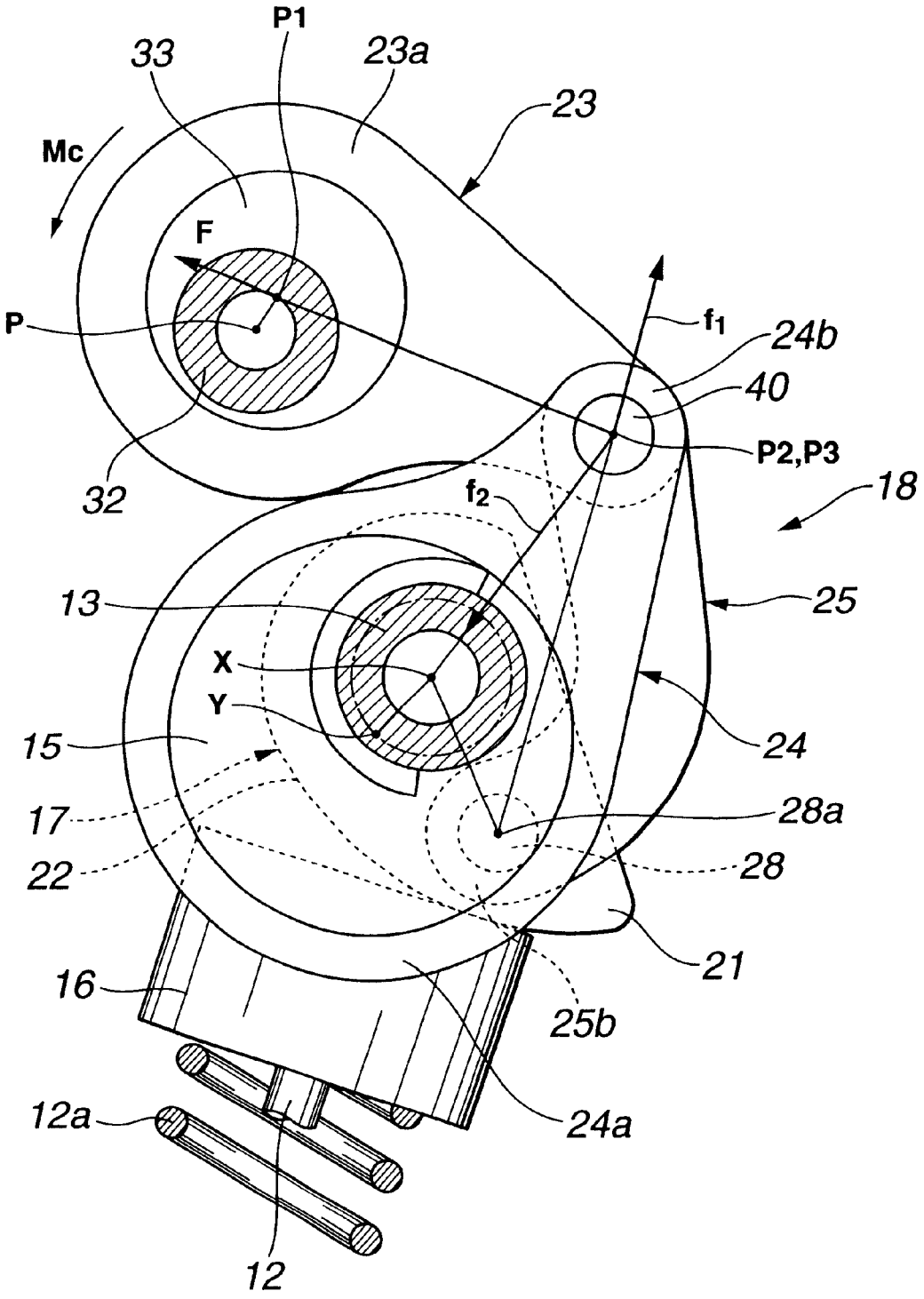
FIG. 6 is a view similar to FIG. 4, showing a second embodiment of the present invention.
Figure 7:
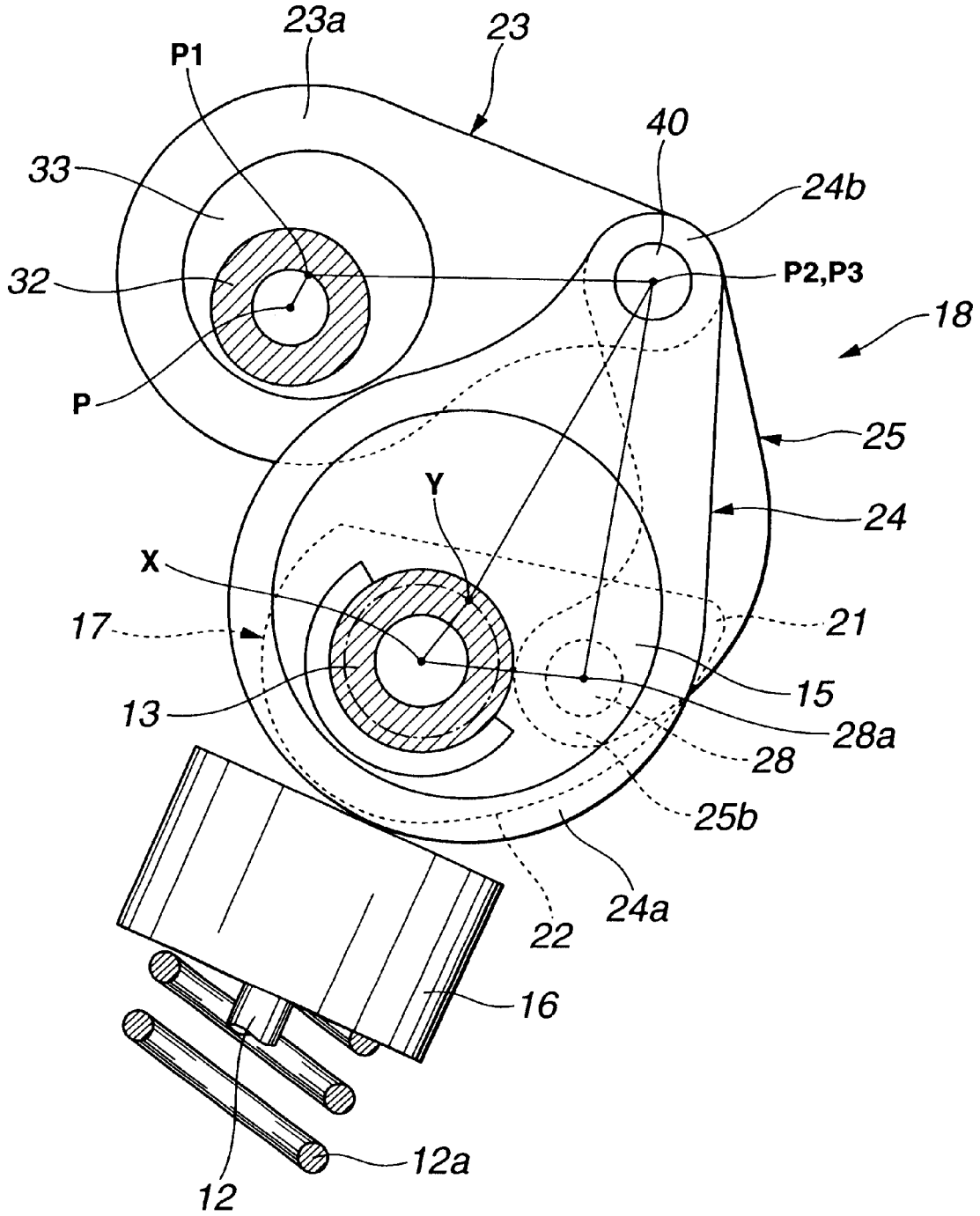
FIG. 7 is a view similar to FIG. 6, showing the apparatus in the valve-closed state.

FIGS. 6–7 show a second embodiment of the present invention wherein a single pin 40 is used to connect the extension 24*b* of the crank arm 24 coupled with the second arm 23*b* of the rocker arm 23 and the first end 25*a* of the link rod 25, thereby coaxially disposing the second and third pivotal points P2, P3. FIG. 6 shows the valve-open state (the instant of reaching the maximum lift), and FIG. 7 shows the valve-closed stated.

In the second embodiment, upon opening of the intake valves 12 in the maximum lift range as shown in FIG. 6, the second and third pivotal points P2, P3 are located on the side of the second arm 23*b* of the rocker arm 23 in the same way as in the first embodiment, obtaining smaller value of the load F due to cancellation of the reaction forces $f_1$, $f_2$. Moreover, coaxial arrangement of the second and third pivotal points P2, P3 contributes to less interference between component parts. This allows, for example, an increase in clearance between the crank arm 24 and the control shaft 32, and a decrease in area defined by a rocking locus of the crank arm 24 and that of the link rod 25, leading to improved layout-ability and reduced size of the apparatus.

Moreover, the single pin 40 serves to support the crank arm 24 and the link rod 25, resulting in simplified structure with reduced number of parts, easy assembling work, and lowered manufacturing cost.

Figure 8:
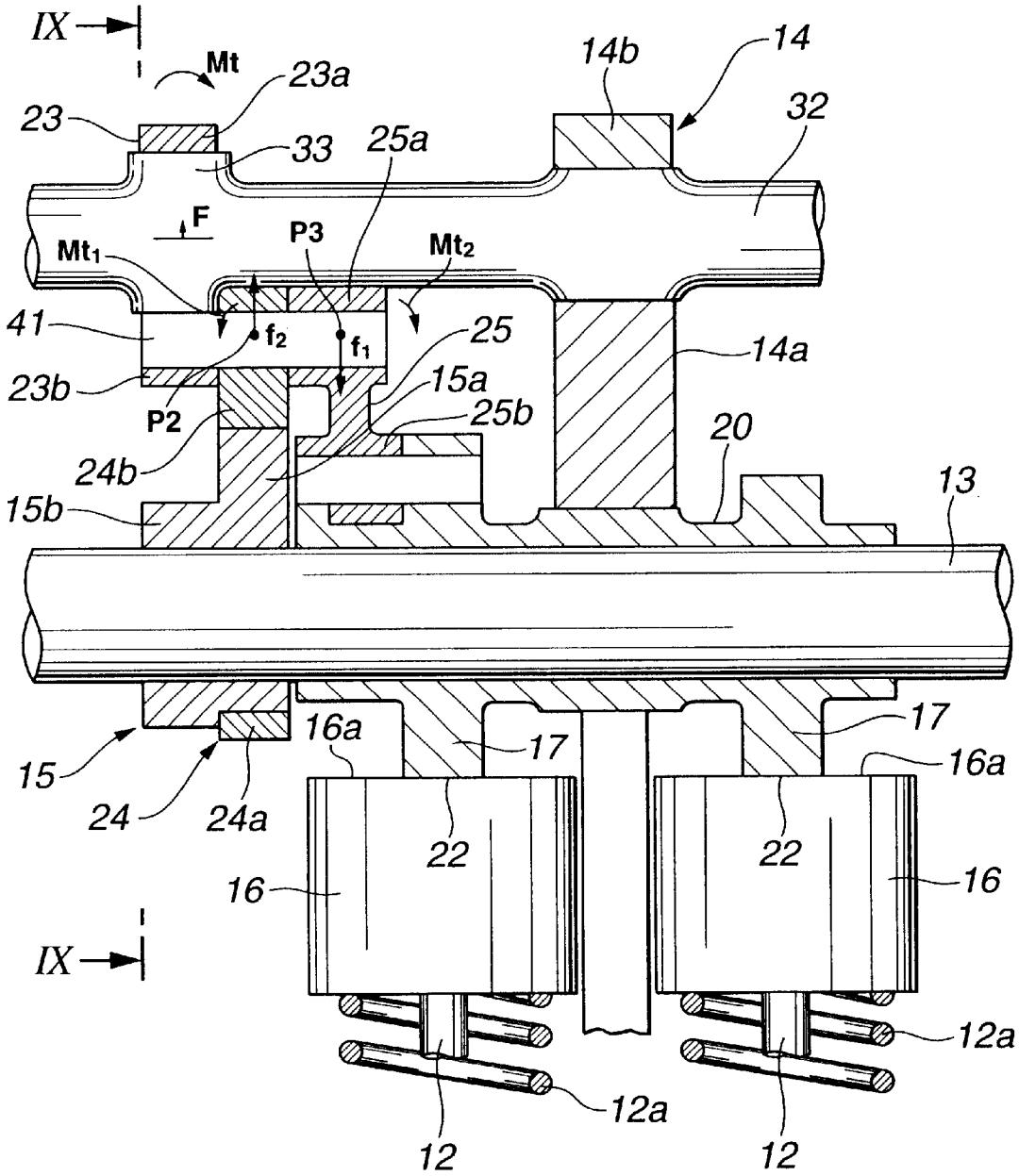
FIG. 8 is a fragmentary longitudinal sectional view showing a third embodiment of the present invention.
Figure 9:
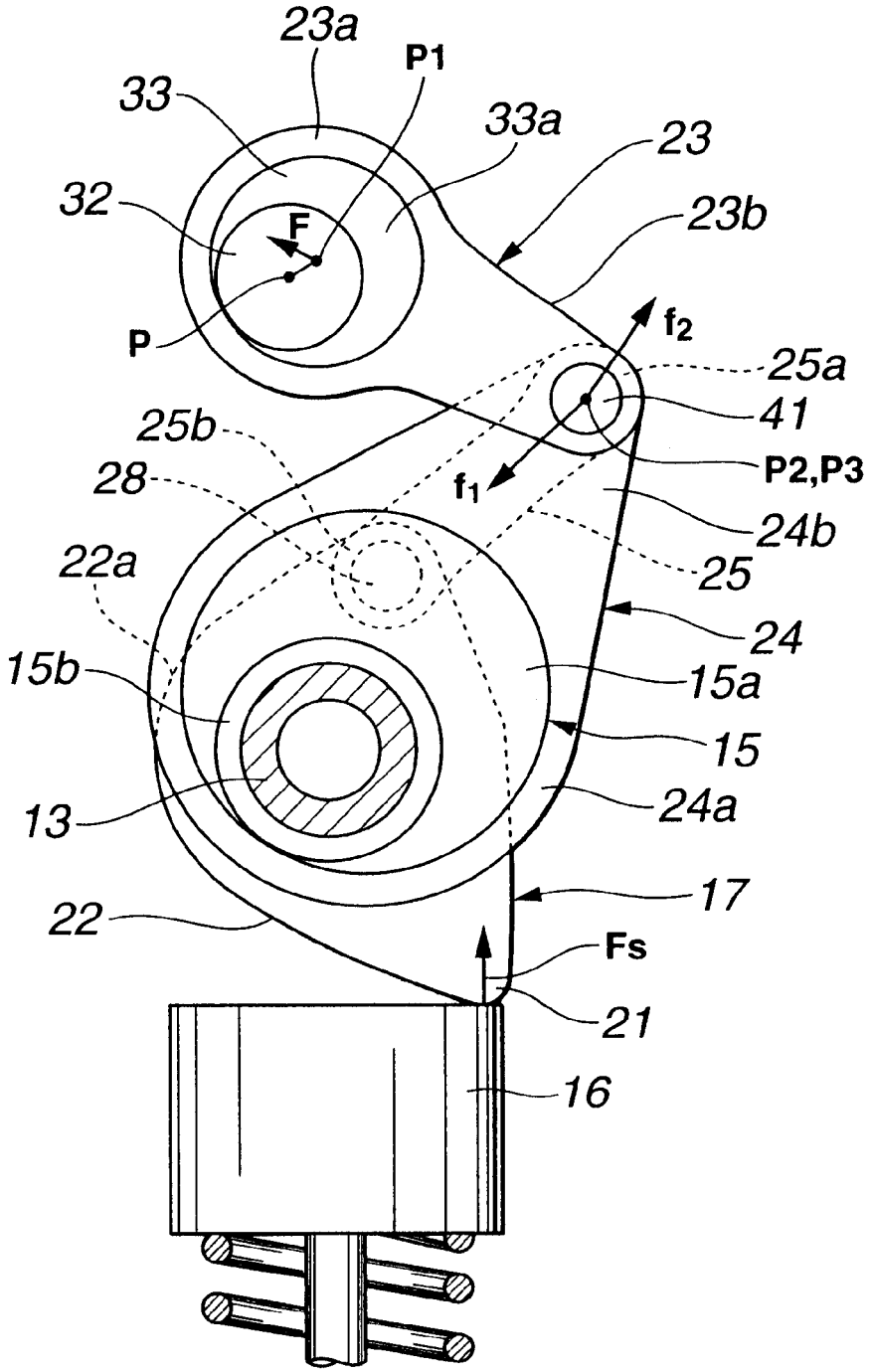
FIG. 9 is a sectional view taken along the line IX—IX in FIG. 8.

FIGS. 8–9 show a third embodiment of the present invention wherein the extension 24*b* of the crank arm 24 and the first end 25*a* of the link rod 25 are arranged parallel and adjacent to one side of the second arm 23*b* of the rocker arm 23, and not on both sides thereof, the extension 24*b* and the first end 25*a* being rotatably coupled with the second arm 23*b* by a single pin 41. Thus, the second and third pivotal points P2, P3 are disposed adjacent to each other. Moreover, the second end 25*b* of the link rod 25 is rotatably coupled, though a pin 28, with an upper end of the first VO cam 17 on the side of the base-circle face 22*a*, and not on the side of the cam nose 21. When pushing the link rod 25 upward, the cam nose 21 of the VO cam 17 is depressed to open the intake valve 12.

In the third embodiment wherein the second end 25*b* of the link rod 25 is coupled with the first VO cam 17 on the side of the base-circle face 22*a*, while the first reaction force $f_1$ produced against the force Fs is opposite in direction to that in the first and second embodiments, and the second reaction force $f_2$ is also opposite in direction, the reaction forces $f_1$, $f_2$ operate in the opposite directions in the same way as in the first and second embodiments, obtaining the same load F reducing effect. Furthermore, the link rod 25 does not protrude outward, having a layout advantage.

Moreover, in the third embodiment, the extension 24*b* and the first end 25*a* are arranged parallel to one side of the second arm 23*b* of the rocker arm 23, avoiding prying phenomena so called during operation.

Specifically, when the extension 24*b* of the crank arm 24 and the first end 25*a* of the link rod 25 are arranged on both sides of the second arm 23*b* of the rocker arm 23, respectively, the second arm 23*b* of the rocker arm 23 undergoes a prying moment $Mt_2$ produced by the first reaction force $f_1$ on the side of the VO cams 17 and a prying moment $Mt_1$ produced by the second reaction force $f_2$ on the side of the crank cam 15 in the same direction as that of the moment $Mt_2$, which may result in occurrence of a great prying moment Mt ($=Mt_1+Mt_2$) at the first arm 23*a* of the rocker arm 23. As a consequence, a collision occurs between the inner peripheral surface of the support hole of the first arm 23*a* and the outer peripheral surface of the control cam 33 to increase a frictional resistance, leading to possible deterioration of rotation-ability of the control cam 33.

On the other hand, when the extension 24*b* and the first end 25*a* are arranged at one side of the second arm 23*b* of the rocker arm 23 as in the third embodiment, the prying moments $Mt_1$, $Mt_2$ operate in the opposite directions. As a result, the prying moments $Mt_1$, $Mt_2$ are cancelled to obtain sufficiently reduced prying moment Mt to the first arm 23*a* of the rocker arm 23, preventing undesirable phenomena such as collision of the rocker arm 23, obtaining always excellent rotation of the control cam 33.

Figure 10:
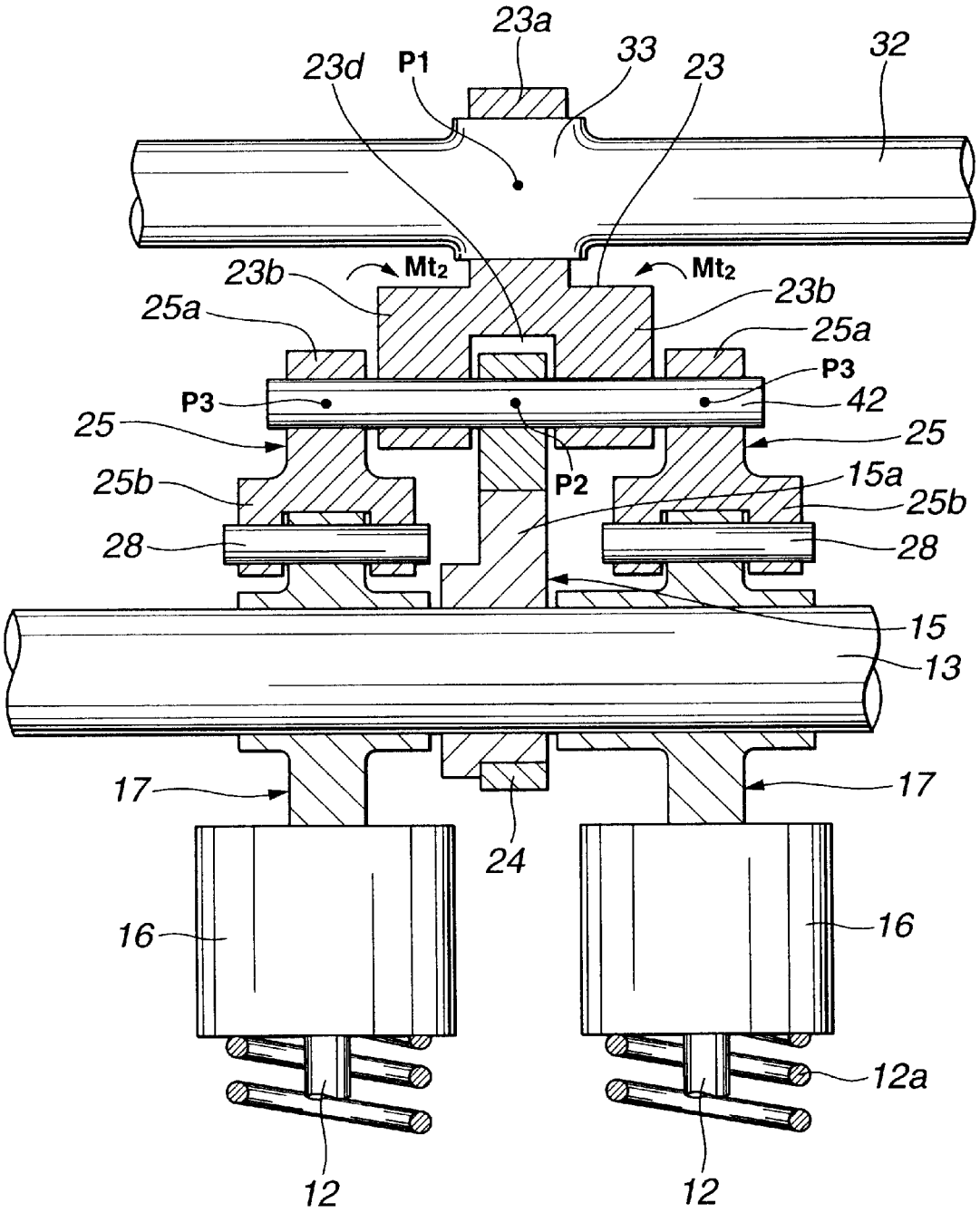
FIG. 10 is a view similar to FIG. 8, showing a fourth embodiment of the present invention.

FIG. 10 shows a fourth embodiment of the present invention wherein the VO cams 17 are arranged separately distinctly to abut on the respective intake valves 12 independently, and two link rods 25 are arranged to correspond to the respective VO cams 17. Moreover, the second arm 23*b* of the rocker arm 23 is bifurcated into two portions having a space 23*d* therebetween. The extension 24*b* of the crank arm 24 on the side of the crank cam 15 is arranged in the space 23*d,* and the first ends 25*a* of the link rods 25 are arranged on both outer sides of the second arm 23*b*. The extension 24*b* and the first ends 25*a* are coaxially coupled with each other by a single pin 42 arranged through the second arm 23*b*. This allows the second pivotal point P2 and the two third pivotal points P3, P3 to be arranged on the side of the second arm 23*b*.

Likewise, the second end 25*b* of each link rod 25 is bifurcated into two portions between which a top of an end of the corresponding VO cam 17 is held. The VO cams 17 are rotatably supported through pins 28 arranged through the second arms 25*b*.

Since the second pivotal point P2 is disposed between the two third pivotal points P3, P3, the prying moments $Mt_2$, $Mt_2$ at the third pivotal points P3, P3 operate in the opposite directions, obtaining remarkably lowered prying or falling moment Mt to the rocker arm 23. This results in extremely reduced prying moment acting on the control cam 33, allowing further excellent rotation of the control cam 33.

Moreover, the single pin 42 serves to coaxially couple the extension 24*b* with the first ends 25*a,* obtaining simplified structure and reduced number of parts, resulting in advantage in assembling efficiency and manufacturing cost.

Furthermore, since the end of each VO cam 17 is enveloped by the bifurcated second end 25*b* of each link rod 25 for two-point support, the VO cam 17 can be prevented from falling, obtaining always excellent support for rotation of the VO cam 17.

Having described the present invention with regard to the illustrative embodiments, it is noted that the present invention is not limited thereto, and various changes and modifications can be made without departing from the scope of the present invention.

The entire contents of Japanese Patent Application 2000-220397 are incorporated hereby by reference.

What is claimed is:

1. A variable-valve-actuation (VVA) apparatus for an internal combustion engine, comprising:

a driving shaft that rotates in synchronism with a crankshaft;

a crank cam arranged at an outer periphery of the driving shaft;

a valve operating (VO) cam which actuates an engine valve in accordance with a swing motion; and a rocker arm having an end swingably mounted to an eccentric control cam at a first pivotal point, the rocker arm being rotatably mounted to the crank cam and the VO cam at a second pivotal point and a third pivotal point, respectively, the rocker arm transmitting a driving force of the crank cam to the VO cam by operation of the swing motion, wherein a lift of the engine valve produced by the VO cam being varied by changing a rocking fulcrum of the rocker arm through rotation control of the control cam, and wherein the second pivotal point and the third pivotal point being located on the side of another end of the rocker arm, the second pivotal point and the third pivotal point being disposed adjacent to each other.

2. The VVA apparatus as claimed in claim 1, wherein the second pivotal point and the third pivotal point are disposed substantially coaxially.

3. The VVA apparatus as claimed in claim 1, further comprising a link rod having a first end rotatably mounted to the another end of the rocker arm.

4. The VVA apparatus as claimed in claim 3, wherein the link rod has a second end rotatably mounted to a cam nose of the VO cam.

5. The VVA apparatus as claimed in claim 3, wherein the link rod has a second end rotatably mounted to a base end of the VO cam.

6. The VVA apparatus as claimed in claim 1, wherein the another end of the rocker arm is bifurcated into two portions, wherein the second pivotal point is located between the two portions, and the third pivotal points are located at both outer sides of the two portions.

7. The VVA apparatus as claimed in claim 6, further comprising a single pin arranged through the two portions of the another end of the rocker arm, wherein the second pivotal point and the third pivotal points are disposed in the single pin.

8. An internal combustion engine, comprising:

a crankshaft;

a driving shaft that rotates in synchronism with the crankshaft;

a crank cam arranged at an outer periphery of the driving shaft;

a valve operating (VO) cam which actuates an engine valve in accordance with a swing motion; and a rocker arm having an end swingably mounted to an eccentric control cam at a first pivotal point, the rocker arm being rotatably mounted to the crank cam and the VO cam at a second pivotal point and a third pivotal point, respectively, the rocker arm transmitting a driving force of the crank cam to the VO cam by operation of the swing motion, wherein a lift of the engine valve produced by the VO cam being varied by changing a rocking fulcrum of the rocker arm through rotation control of the control cam, and wherein the second pivotal point and the third pivotal point being located on the side of another end of the rocker arm, the second pivotal point and the third pivotal point being disposed adjacent to each other.

9. The internal combustion engine as claimed in claim 8, wherein the second pivotal point and the third pivotal point are disposed substantially coaxially.

10. The internal combustion engine as claimed in claim 8, further comprising a link rod having first end rotatable mounted to the another end of the rocker arm.

11. The internal combustion engine as claimed in claim 10, wherein the link rod has a second end rotatably mounted to a cam nose of the VO cam.

12. The internal combustion engine as claimed in claim 10, wherein the link rod has a second end rotatably mounted to a base end of the VO cam.

13. The internal combustion engine as claimed in claim 8, wherein the another end of the rocker arm is bifurcated into two portions, wherein the second pivotal point is located between the two portions, and the third pivotal points are located at both outer sides of the two portions.

14. The internal combustion engine as claimed in claim 13, further comprising a single pin arranged through the two portions of the another end of the rocker arm, wherein the second pivotal point and the third pivotal points are disposed in the single pin.

* * * * *